United States Patent [19]

Alford

[11] 4,434,843

[45] Mar. 6, 1984

[54] HEAT EXCHANGER APPARATUS

[75] Inventor: Arthur L. Alford, Oklahoma City, Okla.

[73] Assignee: International Environmental Manufacturing Co., Oklahoma City, Okla.

[21] Appl. No.: 896,708

[22] Filed: Apr. 17, 1978

[51] Int. Cl.[3] ..... F28F 1/32

[52] U.S. Cl. ..... 165/150; 29/157 R; 29/3; 62/526

[58] Field of Search ..... 165/156, 157, 175, 176, 165/194; 62/515, 526

[56] References Cited

U.S. PATENT DOCUMENTS

| | | | |
|---|---|---|---|
| 2,669,099 | 2/1954 | Malkoff | 165/144 X |
| 4,053,014 | 10/1977 | Neff | 165/150 |
| 4,089,368 | 5/1978 | Bell et al. | 165/150 |

*Primary Examiner*—William R. Cline
*Assistant Examiner*—Theophil W. Streule, Jr.
*Attorney, Agent, or Firm*—Dunlap & Codding

[57] ABSTRACT

An improved heat exchanger apparatus that serves alternatively as an evaporator and as a condenser, the heat exchanger apparatus comprising a frame and a heat exchange coil supported by the frame, the coil having a first coil end portion, a coil medial portion and a second coil end portion. The coil passes sinuously between ends of the frame such that the first coil end portion and the second coil end portion are disposed in the first coil row that is first contacted by air blown through the exchanger, and the coil medial portion is disposed to pass sinuously in subsequent coil rows so that approximately one half of the coil medial portion passes in co-flow heat exchange relationship to the air and approximately one half of the coil medial portion passes in counter-flow heat exchange relationship to the air.

3 Claims, 9 Drawing Figures

HEAT EXCHANGER APPARATUS

BACKGROUND OF THE INVENTION

1. Field of Invention

The present invention relates generally to air conditioning apparatus, and more particularly, but not by way of limitation, to an improved heat exchanger for use in a heat pump apparatus.

2. Discussion of Prior Art

The heat pump, or reverse cycle air conditioning, has been known for well over a century, having been proposed by Nicholas and Kevin in the nineteenth century. However, it wasn't until after World War II that factory build units become commercially available in this country. Even though the heat pump proved to have superior operating efficiency, not much happened in the way of sales of such units immediately following their introduction, mostly due to the fact that fossil fuels were available in abundance, making energy very inexpensive and operating efficiency relatively unimportant.

These circumstances prevailed until the worldwide energy crisis that developed in 1973, when energy became scarce and the price of energy soared. In response to this, people throughout the world, and especially in this country, began searching for methods to cut consumption and to conserve the amount of energy used to perform heating and air conditioning functions.

Against this background, heat pump economics took on a new and more favorable light, and sales of such units have begun to skyrocket. Some predict that the heat pump will dominate the air conditioning market in the years to come.

The principle of the heat pump is simple, as the heat pump uses a closed loop of refrigerant fluid to move heat from one area to be dissipated at another area. Instead of generating heat, as does the conventional fossil furnace, the heat pump uses energy to move energy, and does its job at about half the operating cost required by conventional air conditioning apparatus.

A typical air to air heat pump apparatus has an outside heat exchanger and an inside heat exchanger. For cooling, a compressor compresses the refrigerant, and by means of precisioned valving, the compressed fluid is passed to either the outside heat exchanger or the inside heat exchanger. In the cooling mode of the heat pump, the refrigerant is first passed through the outside exchanger and then through the inside exchanger. In the heating mode, this is reversed, with the refrigerant first being passed through the inside exchanger and then through the outside exchanger. In effect, during winter months, heat is extracted from the outside air by the refrigerant which is pumped inside to transfer this heat to inside air. In the summer months, heat from room air is picked up by the refrigerant which is pumped outside to transfer the heat to outside air.

Thusly, a water-source heat pump is similar to that which has been described above for an air to air type heat pump apparatus, with the exception that the outside heat exchanger is replaced with a water-refrigerant heat exchange coil that may be located inside. A source of water supplies a stream of water to the water side of the water refrigerant heat coil, and the discharge water is raised or lowered in temperature depending upon whether the heat pump is in the cooling mode or in the heating mode. The other heat exchanger of the water-source heat pump apparatus is the same as the inside heat exchanger of the air to air heat pump apparatus.

For both types of heat pumps discussed above, the inside heat exchanger is required to function alternately as an evaporating coil and as a condensing coil, and the coil must be designed differently than if the heat exchange coil always serves one purpose or the other. For example, fin spacing and face area are different for each of the cooling and heating modes. As a result, the conventional approach has been to compromise these requirements, leading to an optimization that, in theory, would favor neither the cooling or heating mode requirements, but which also would reduce the efficiency of each of the modes. The same considerations, of course, are applicable to the outside heat exchanger of an air to air heat pump apparatus.

In practice, manufacturers have usually favored the cooling mode, and have augmented the heating mode with auxiliary electric heaters. That is, the great majority of prior art units that have been sold in this country have been designed to achieve maximum cooling efficiency; as a consequence, the heating efficiency of such units has been relatively poor. On the other hand, there have been some manufacturers that have favored the heating mode, but their heat pumps have had relatively poor cooling efficiency. Because of these relatively poor heating or cooling efficiencies, a common practice has been to compensate by supplying oversized heat exchangers.

It would be desirable if a heat exchanger could be designed for a heat pump that would afford maximum cooling and heating efficiencies without requiring oversized exchangers to achieve effective cooling and heating performance.

SUMMARY OF THE INVENTION

The present invention provides an improved heat exchanger for use with a heat pump apparatus that utilizes a refrigerant fluid enclosed in a closed loop and which is selectively passed in alternate directions through the heat exchanger, the direction of flow depending upon whether the heat pump is in the heating mode or in the cooling mode. The heat exchanger of the present invention is comprised of a frame having a first end member and a second end member, the first and second end members defining an air flow channel therebetween through which air as a heat exchange medium is passable. A heat exchange coil is supported by, and passed sinuously between, the first and second end members, the coil being disposed across the air flow passageway in heat exchange relationship to air passing through the air flow channel. The coil has a first coil end portion, a coil medial portion and a second coil end portion, and both the first coil end portion and the second coil end portion are disposed near the air inlet portion of the air flow channel so that each of the first and second coil end portions are contacted by portions of the freshest air as it first enters the air flow channel.

This arrangement permits each of the first and second coil end portions to serve as either the entering portion of the coil for the refrigerant, or as the final conditioning stage for the refrigerant as it exits the coil. This feature assures complete condensation or vaporation is achieved as the heat exchanger is used as a condenser or as an evaporator.

Accordingly, it is an object of the present invention to provide an improved heat exchanger for a heat pump or the like which provides maximum efficiency for the heat pump in either its heating or cooling mode.

Another object of the present invention, while achieving the above object, is to provide an improved heat exchanger that requires a minimum of heating area to achieve effective cooling and heating performance.

Another object of the present invention, while achieving the above objects, is to provide an improved heat exchanger that offers ease of manufacture, and which is compatible with other components of prior art heat pumps.

Other objects, features and advantages of the present invention will be apparent when the following detailed description is read in conjunction with the drawings and appended claims.

DESCRIPTION OF THE INVENTION

Figure 1:
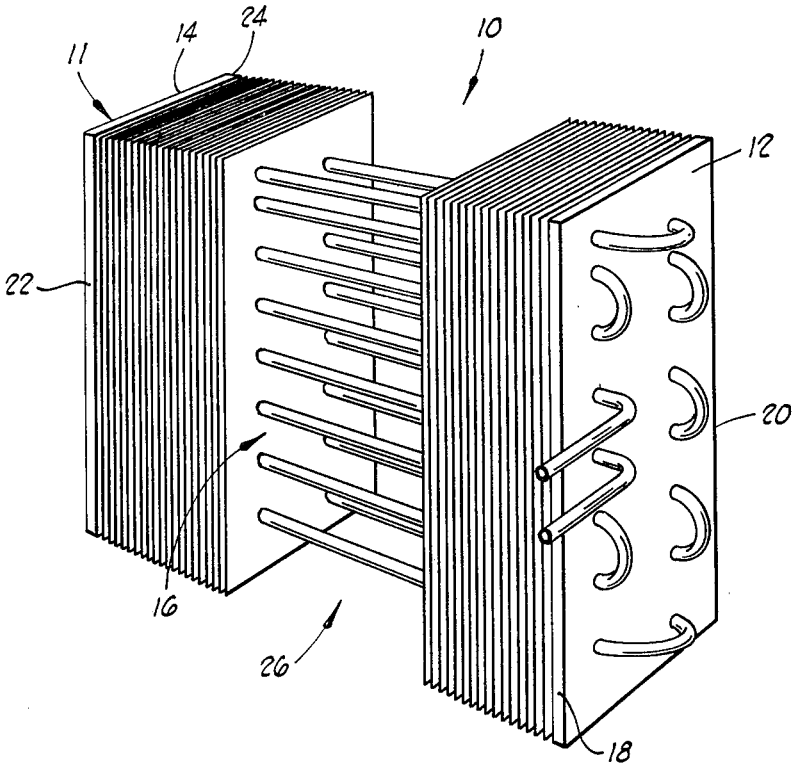
FIG. 1 is a partial cutaway, isometric view of a heat exchanger constructed in accordance with the present invention.

Referring to the drawings in general, and particularly with reference to FIG. 1, shown therein and designated by the numeral 10 is an improved heat exchanger constructed in accordance with the present invention. The heat exchanger 10, shown in partial cutaway, isometric view in FIG. 1, is comprised of a frame 11 that has a first end member 12 and a second end member 14, the first and second end members 12, 14 being generally parallel and spaced-apart rectangularly-shaped members. The spaced-apart first and second end members 12 and 14 define an air flow channel 16 therebetween. Although none are shown in FIG. 1, cross struts may be utilized as necessary to provide the rigidity necessary for the frame 11.

The first end member 12 has a front end 18 and a rear end 20. The second end member 14 has a front end 22 and a rear end 24. The plane that encompasses the front end 18 and the front end 22 defines an air entering face to the air channel 16, and the plane containing the rear end 20 and the rear end 24 defines an air exiting face.

Figure 2:
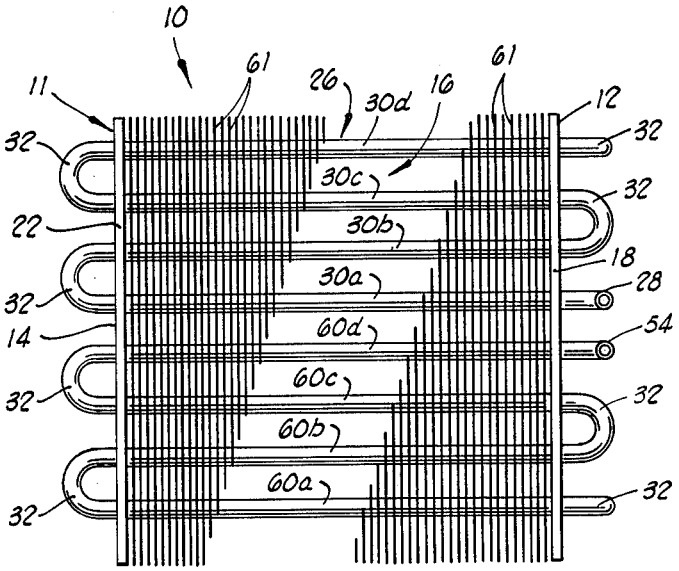
FIG. 2 is a front elevational view of the heat exchanger shown in FIG. 1.
Figure 3:
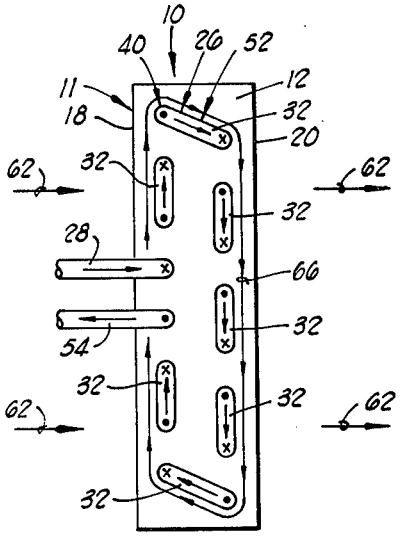
FIG. 3 is an elevational view of one end of the heat exchanger shown in FIG. 1 and is marked to indicate one direction of fluid flow therethrough.
Figure 4:
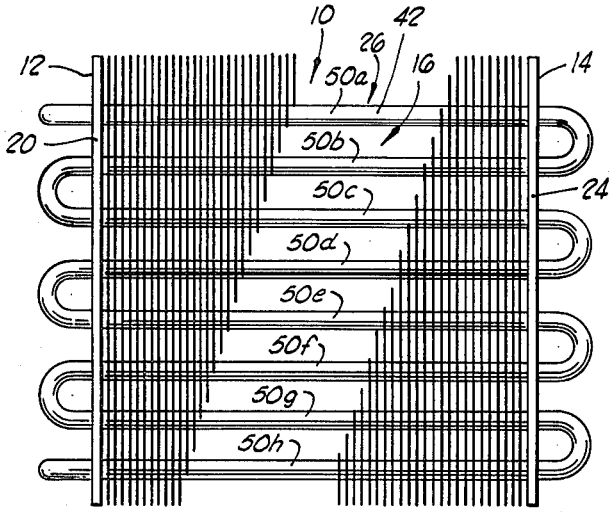
FIG. 4 is a rear elevational view of the heat exchanger shown in FIG. 1.

The heat exchanger 10 further comprises a heat exchanger coil 26 that is supported by the frame 11 and which extends across the air flow channel 16, making multiple passes between the first and second end members 12 and 14, as best illustrated by the FIGS. 2 through 4.

FIG. 2 is a partial cutaway, front elevational view of the heat exchanger 10; FIG. 3 is an elevational view of the heat exchanger 10 showing the first end plate 12; and FIG. 4 is a partial cutaway, elevational view of the rear end of the heat exchanger 10. As depicted in FIG. 3, the coil 26 has a first end portion 28 that passes through an aperture in the first end member 12 near the front end 18, makes a pass 30*a* across the air flow channel 16 and extends through an aperture in the second end member 14 near its front end 22. The first coil end portion 28 of the coil 26 then curves at the coil bend 32 and extends through another aperture in the second end member 14 to make a pass 30*b* across the air flow channel 16.

The first coil end portion 28 continues to make multiple passes in serpentine fashion, extending through appropriately located apertures in the first and second end members 12 and 14, to form passes 30*c* and 30*d* which are joined by coil bends 32 as shown in FIG. 2. The coil passes 30*a*, 30*b*, 30*c*, and 30*d* of the first coil end portion 28 of the coil 26 are disposed in generally parallel fashion to form a first coil row 40 in the frame 11.

The coil 26 has a medial portion 42 that continues from the coil pass 30*d* to extend sinuously in the form of multiple coil passes across the flow channel 16, thus forming the coil passes 50*a* through 50*h* as viewed in FIG. 4. The coil passes 50*a* through 50*h* are generally parallel and form a second coil row 52 that is subsequent to the first coil row 40 in the frame 11, and each of the coil passes 50*a* through 50*h* are offset from passes of the coil 26 that are disposed in the first coil row 40 for the purpose of establishing better contact with the air flowing through the air flow channel 16.

The coil 26 has a second coil end portion 54 that extends from the coil bend 32 connected to the coil pass 50*h*. The second coil end portion 54 makes several passes 60 through 60*d* that are generally parallel and disposed in the first coil row 40 along with the above described passes 30*a* through 30*d* of the first coil end portion 28.

The first coil end portion 28 of the coil 26 extends from the first end member 12 to form a short extension portion, as does the second end portion 54, for attachment thereto of conduits leading to other components of a heat pump apparatus.

As shown in FIGS. 1, 2 and 4, a plurality of heat exchange ribs 61 are disposed in the air channel 16. A portion of the heat exchange ribs have been deleted in these figures in order to more clearly show the coil passes that extend across the air flow channel 16. The heat exchange ribs 61 are thin members that are constructed of a metal having a high conductivity to heat, and these may be slightly wavy in configuration to increase the travel distance of the air blown through the channel. The coil passes extend through appropriately located apertures in the heat exchange ribs 61, and if desired, the ribs 61 may be brazed to the coil passes. Also, the coil 26 may be brazed to the first and second end members 12, 14 to provide a more rigid assembly.

In operation, air will be forced to flow in the direction depicted by the arrow 62: across the air entering face; through the air flow channel 16, following a tortuous route therethrough; and out the air exiting face at the rear of the heat exchanger 10. The greatest temperature differential between the air and refrigerant fluid flowing in the coil 26 will occur at the coil passes of the coil 26 that are disposed in the first coil row 40, and the subsequent coil row 52 will be contacted with air affected by temperature exchange with the coil passes located in the first coil row 40.

In this arrangement of the present invention, the first coil end portion 28 will be contacted by approximately fifty percent of the entering air, and the second coil end portion 54 will also be contacted with approximately fifty percent of the entering air. Thus, each one of the first and second coil end portions 28, 54 is contacted with the freshest heat exchange medium flowing through the heat exchanger 10, which of course, is the entering air.

Figure 5:
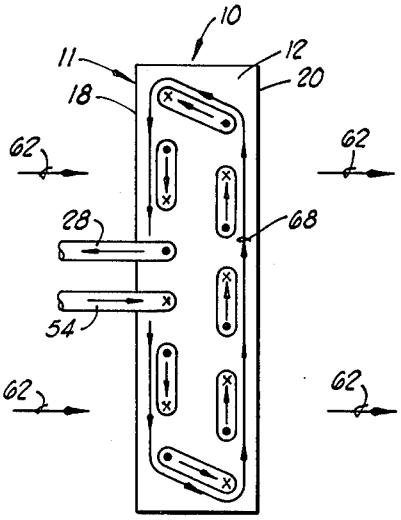
FIG. 5 is an elevational view of one end of the heat exchanger shown in FIG. 1 and is the same as FIG. 3 with the exception that FIG. 5 indicates a fluid flow in the reverse direction to that shown in FIG. 3.

The flow of fluid through the coil 26 is indicated in FIG. 3 in a first flow direction, and in FIG. 5, the flow is indicated in the opposite flow direction. That is, in FIG. 3, by way of example, a hot vaporous fluid is passed into the entering portion of the first coil end portion 28 and flows through the coil passes 30*a* through 30*d* in the front coil row 40, through the passes 50*a* through 50*h* in the second coil row 52, and then again flows through the first coil row 40 via the passes 60*a* through 60*d*. The vapor is condensed as it passes through the coil 26, and the second coil end portion 54 serves as a final heat conditioning stage for the exiting refrigerant fluid, thus assuring the complete condensation of the vapor prior to the exiting of the refrigerant from the coil 26.

As shown in FIG. 3, the first flow direction, as just described, is indicated by arrows on the extension portions of the first and second end portions 28, 54 and on the coil bends 32, and also by the placement of a dot and an X at each end of the bends 32 shown thereon. The X depicts the rear end of an arrow extending into the plane of the drawing, and a dot is the front end of an arrow extending from the plane of the drawing. In this scheme of flow depiction, the flow of refrigerant fluid through the coil 26 can be understood by reference simply to the end elevational views of FIGS. 3 and 5.

FIG. 5 depicts the reverse fluid flow to that depicted in FIG. 3, and would, as by way of example, represent the flow of a compressed refrigerant fluid entering the extension portion of the second coil end portion 54 of the coil 24 and moving sinuously via the multiple passes extending between the first and second end members 12 and 14 to progress in mass movement as indicated by the arrow line 66. As the refrigerant flows through the coil 26 in the manner depicted in FIG. 5, the fluid first goes through the second end portion 58 (coil passes 60*d* through 60*a*); then the fluid goes through the medial portion 42 (coil passes 50*h* through 50*a*); and finally the fluid goes through the first end portion 28 (coil passes 30*d* through 30*a*). In this direction of fluid flow, it will be recognized that the first coil end portion 28, being the last portion of the coil travelled, serves as a final heat conditioning stage in which the refrigerant is passed in heat exchange relationship to about half of the freshest entering air flowing through the air flow channel 16 in the heat exchanger 10. This assures complete vaporization of the fluid prior to passing on to other heat pump components.

Figure 6A:
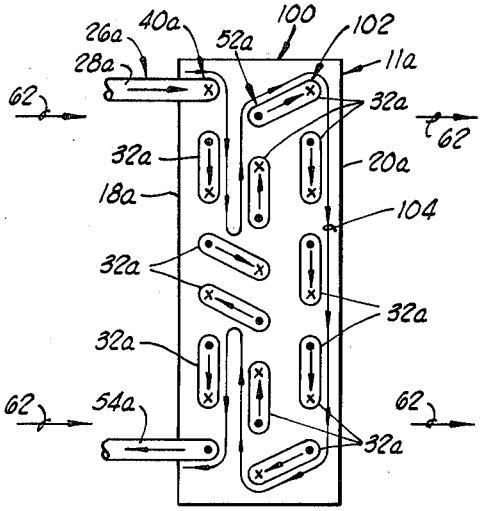
FIGS. 6A and 6B are elevational end views of one end of another heat exchanger constructed in accordance with the present invention, FIG. 6A indicating one direction of fluid flow through the exchanger and FIG. 6B indicating a fluid flow in the reverse direction therethrough.
Figure 6B:
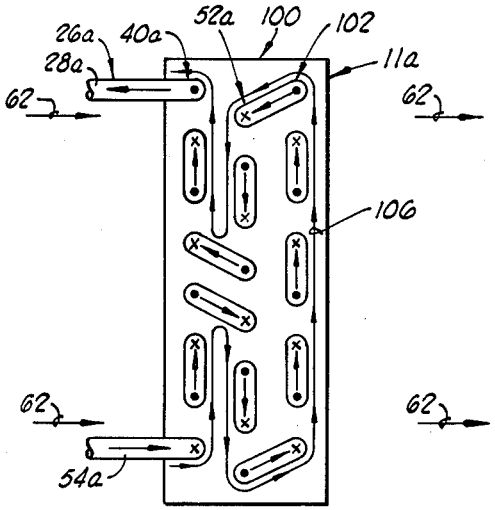

The discussion that has been provided above has been relative to the double row heat exchanger 10. Multiple row exchangers can also be constructed in accordance with the present invention, and two such embodiments will now be discussed. FIGS. 6A and 6B show an elevational view of a heat exchanger 100 constructed in exactly the same manner as described for the heat exchanger 10 with the exception that the heat exchanger 100 has three rows of coil passes: a first coil row 40*a;* a second coil row 52*a;* and a third coil row 102.

As above explained, the flow pattern can be discerned in FIGS. 6A and 6B by reference to the dot and X that have been placed on each coil bend 32*a*, and by the flow arrows thereon. The arrow line 104 depicts the progress of mass flow through the heat exchanger 100.

In the heat exchanger 100, a coil 26*a* is supported by a frame 11*a* and has a first coil end portion 28*a* that is formed into several coil passes that extend across the air channel 16*a* that extends through the frame 11*a* of the heat exchanger 100. As above, the coil passes of the first coil end portion 28*a* are disposed in the first coil row 40*a* so as to be in heat exchange relationship to a first portion of the entering air. Also, a medial portion of the coils 26*a* passes sinuously toward the rear of the frame 11*a* via coil passes in the second coil row 52*a* to reach the third coil row 102. To this point in its travel, the refrigerant has passed in co-flow heat exchange relationship to the first portion of entering air, the entering air that has contacted the coil passes of the first coil end portion 28*a* disposed in the first coil row 40*a*. Once the refrigerant has travelled through the coil passes located in the third coil row 102, the refrigerant begins to flow generally toward the front of the heat exchanger 100 in counter-flow relationship to the second portion of entering air, the entering air that has first contacted the coil passes of the second coil end portion 54*a* that are located in the first coil row 40*a*.

The heat exchanger 100 is also shown in FIG. 6B which depicts the refrigerant flow in the opposite direction to that which is shown in FIG. 6A. The mass flow in FIG. 6B is depicted by the arrow line 106.

Figure 7A:
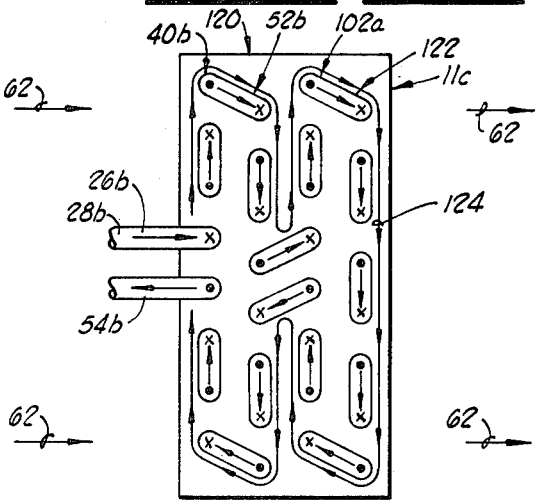
FIGS. 7A and 7B are elevational end views of yet another heat exchanger constructed in accordance with the present invention, with FIG. 7A indicating one direction of fluid flow therethrough and FIG. 7B indicating fluid flow in the reverse direction therethrough.
Figure 7B:
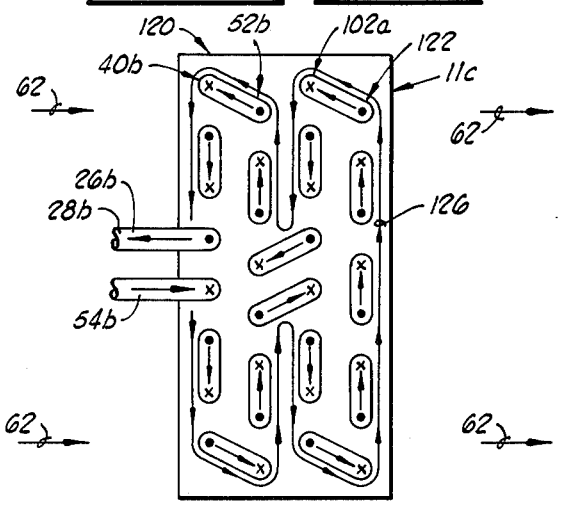

A four row exchanger 120 is depicted in the end elevational views shown in FIGS. 7A and 7B. In FIG. 7A, a coil 26*b* is formed into a first coil row 40*b*, a second coil row 52*b*, a third coil row 102*a*, and a fourth coil row 122, and in the manner described above, the coil 26*b* extends sinuously between end members of the frame 116. The first coil end portion 28*b* comprises the coil passes that are located in one half of the first coil row 40*b*, as described above for the other heat exchangers 10 and 100. The second coil end portion 54*b* comprises the coil passes that are located in the other half of the first coil row 40*b;* thus, the first coil row 40*b*, which is contacted by the freshest air entering the air flow channel 16*b* extending through the frame 11*b*, is occupied by the coil passes of the first and second coil end portions 28*b* and 54*b*.

In FIG. 7A, the refrigerant fluid enters the extension to the first coil end portion 28*b* and progresses as indicated by the arrow line 124. In FIG. 7B, the refrigerant, flowing in the reverse direction to that depicted in FIG. 7A, enters the extension of the second coil portion 54*b* and progresses as depicted by the arrow line 126.

It is clear that in each of the heat exchangers 10, 100 and 120 that have been discussed above, the first and second end portions of the coil are disposed in heat exchange relationship to the entering air. In practice, improved working efficiencies have been obtained for heat pumps equipped with a heat exchanger constructed in accordance with the present invention and constructed as described herein. In water-source heat pumps ranging in capacities up to about five tons, superior efficiencies have been obtained for both the heating and cooling modes by arranging the coil so that at least about five percent of the total external area of the coil disposed in the air flow channel extending from the first end to the medial portion of the coil, and at least about five percent of the external area extending from the second end to the medial portion of the coil are disposed to be contacted by the freshest air entering the air flow channel.

By way of example, prior art water-source heat pumps certified by the Air-Conditioning and Refrigeration Institute, 1815 North Fort Myer Drive, Arlington, Va., have commonly reported coefficients of performance (COP, a parameter used to compare relative heating efficiencies of heat pump exchangers) in the range of 2.7 to 3.0. The same units report energy efficiency ratings (EER, a parameter used to compare the relative cooling efficiencies of heat pump exchangers) to be in the range of 8.0 to 9.2. With few exceptions, the reported units have sacrificed heating efficiency to obtain better efficiency in the cooling mode. No longer is such sacrifice necessary, as the same standard test conducted on heat exchangers conducted in accordance with the present invention reports a COP value of about 3.5 and an EER value of about 9.2. This confirms that the present invention provides maximum efficiency of a heat pump exchanger for both the cooling mode and for the heating mode.

It is clear that the present invention is well adapted to carry out the objects and obtain the ends and advantages mentioned as well as those inherent therein. While some presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. In a heat pump apparatus in which a refrigerant is selectively passed in one direction and in an opposite direction through a heat exchanger having air passed therethrough, an improved heat exchanger comprising:

a frame having an air flow channel through which the air is passed; and a heat exchange coil supported by the frame and forming a first coil row and at least one other coil row subsequent to the first coil row, the coil rows disposed in the air flow channel such that entering air first contacts the first coil row and then the subsequent coil row, the coil characterized as having a first end portion, a medial portion, and a second end portion, the first end portion and the second end portion substantially disposed in the first coil row such that the first end portion and the second end portion are each in a heat exchange relationship with air entering the air flow channel, and the medial portion substantially disposed in at least one coil row subsequent to the first coil row, one of the first and second end portions serving as the entering portion for the refrigerant flow, and the other one of the first and second end portions serving as a final heat conditioning stage for the exiting refrigerant.

2. The improved heat exchanger of claim 1 wherein the first end portion of the heat exchange coil is disposed in heat exchange relationship with approximately fifty percent of the air entering the air flow channel, the second end portion of the heat exchange coil being disposed in heat exchange relationship with approximately fifty percent of the air entering the air flow channel, approximately one half of the medial portion of the heat exchange coil being disposed to pass sinuously in co-flow heat exchange relationship to the air flowing past the entering portion of the heat exchange coil, and approximately one half of the medial portion being disposed to pass sinuously in counter-flow heat exchange relationship to the air flowing past the final heat conditioning stage of the heat exchange coil.

3. The improvement of claim 2 wherein a plurality of heat exchange fin members are connected to the heat exchange coil and disposed in the air flow channel.

* * * * *